US008038800B2

(12) United States Patent
Rossa et al.

(10) Patent No.: US 8,038,800 B2
(45) Date of Patent: Oct. 18, 2011

(54) METHOD AND DEVICE FOR CLEANING THE DOOR OF A COKE OVEN

(75) Inventors: Frank Rossa, Bochum (DE); Hans-Josef Giertz, Ratingen (DE); Friedrich Huhn, Ratingen (DE); Jürgen George, Bochum (DE); Ralf Hoven, Essen (DE); Detlef Mattern, Essen (DE); Friedrich-Wilhelm Cyris, Duisburg (DE); Joachim Strunk, Bottrop (DE); Heinz Opdenwinkel, Dortmund (DE)

(73) Assignees: DMT GmbH, Essen (DE); RAG Aktiengesellschaft, Essen (DE)

( * ) Notice: Subject to any disclaimer, the term of this patent is extended or adjusted under 35 U.S.C. 154(b) by 823 days.

(21) Appl. No.: 11/990,061

(22) PCT Filed: Aug. 7, 2006

(86) PCT No.: PCT/EP2006/007790

§ 371 (c)(1),
(2), (4) Date: Feb. 4, 2008

(87) PCT Pub. No.: WO2007/017223

PCT Pub. Date: Feb. 15, 2007

(65) Prior Publication Data

US 2010/0154825 A1 Jun. 24, 2010

(30) Foreign Application Priority Data

Aug. 10, 2005 (DE) ..... 10 2005 037 768

(51) Int. Cl.
*B08B 7/04* (2006.01)

(52) U.S. Cl. ..... 134/18; 134/20; 134/21; 134/21.11; 134/22.12; 134/22.18; 134/24; 134/32; 134/34; 134/37; 134/39; 134/42; 201/2; 202/241; 202/248

(58) Field of Classification Search ..... 134/18, 134/20, 21, 21.11, 22.12, 22.18, 24, 32, 34, 134/37, 39, 42; 201/2; 202/248, 241
See application file for complete search history.

(56) References Cited

U.S. PATENT DOCUMENTS

| | | | | | |
|---|---|---|---|---|---|
| 2,391,443 | A | * | 12/1945 | Bruton | 201/2 |
| 3,056,699 | A | * | 10/1962 | Randell et al. | 134/5 |
| 3,454,426 | A | * | 7/1969 | Taylor | 134/20 |
| 3,933,595 | A | * | 1/1976 | Gordon et al. | 201/2 |
| 3,988,105 | A | * | 10/1976 | Edwards et al. | 431/121 |
| 4,145,258 | A | * | 3/1979 | Fujishiro et al. | 202/248 |
| 5,013,408 | A | * | 5/1991 | Asai et al. | 202/241 |
| 7,166,197 | B2 | | 1/2007 | Giertz | |

FOREIGN PATENT DOCUMENTS

DE 34 918 1/1965

(Continued)

*Primary Examiner* — Bibi Carrillo
(74) *Attorney, Agent, or Firm* — Andrew Wilford

(57) ABSTRACT

The invention relates to a method and a device for cleaning the door of a coke oven, said door comprising a sealing edge and a membrane that is attached to the door panel of the coke oven. According to said method, cleaning tools comprising jet nozzles, which are supplied with a flow medium at high pressure, are situated and displaced back and forth in the region between the sealing edge and the door panel of the coke oven, in such a way that the interior surface of the membrane and the sealing edge are cleaned. The coke oven door is cleaned directly after the coke oven chamber is opened, by at least one jet nozzle element, which is supplied with compressed air and is displaced along the sealing edges. The jet nozzles are oriented in such a way that the air hits the surface to be cleaned at an acute angle.

14 Claims, 5 Drawing Sheets

FOREIGN PATENT DOCUMENTS

| | | | | |
|---|---|---|---|---|
| DE | 30 14 124 | 10/1981 | | |
| JP | 5 2005 804 | 1/1977 | | |
| JP | 6 023 83 86 | 11/1985 | | |
| JP | 404164991 | A | * | 5/1992 |
| JP | 406100864 | A | * | 4/1994 |
| JP | 406322373 | A | * | 11/1994 |

* cited by examiner

METHOD AND DEVICE FOR CLEANING THE DOOR OF A COKE OVEN

CROSS REFERENCE TO RELATED APPLICATIONS

This application is the US national stage of PCT application PCT/EP2006/007790, filed 7 Aug. 2006, published 15 Feb. 2007 as WO 2007/017223, and claiming the priority of German patent application 102005037768.8 itself filed 10 Aug. 2005, whose entire disclosures are herewith incorporated by reference.

FIELD OF THE INVENTION

The invention relates to a method of and an apparatus for cleaning a coke-oven door.

BACKGROUND OF THE INVENTION

Coke-oven doors are intended to guarantee gas-tight sealing of the coke-oven chamber. For this purpose, numerous seals have been developed for coke-oven doors. Despite the high state of technical development of the seals, careful maintenance of the sealing surfaces on the coke-oven door and the door frame are prerequisites to ensure gas-tight sealing of the chamber.

Both mechanical cleaning apparatuses and cleaning by high-pressure water are known. During mechanical cleaning, brushes, scrapers, graters or wipers and cutting devices are used. These cleaning devices have the disadvantage they require a great deal of time for the cleaning operation and still only have a low cleaning effect because the cleaning tools are not well suited to cleaning these surfaces. In addition, they pose the risk of damaging the seal strips. After extended use of the mechanical cleaning devices, the seal strips definitely become worn. In addition, the cleaning tools are subject to wear and must be replaced at regular intervals.

When cleaning by high-pressure water, contaminated waste water poses a problem.

From DE 30 14 124 C2 a coke-oven door cleaning apparatus is known, proposing the use of mechanical cleaning tools as well as cleaning tools using a high-pressure fluid, e.g. water or steam, for cleaning the coke-oven door.

This type of cleaning has the disadvantage that the cleaning operation is very complex and is associated with the drawbacks of both the mechanical cleaning method of and the cleaning by high-pressure water, that is the development of polluted waste water.

From DE 101 61 659 [U.S. Pat. No. 7,166,197] a coke-oven door (DMT door) is known whose seal strips have such a large spring-loaded seal travel that they can compensate for any deformations occurring during the coking process, thus guaranteeing complete sealing at all times. Also with this door, the level of dirtiness or cleanliness is of crucial importance for the sealing effectiveness and hence for emissions.

OBJECT OF THE INVENTION

It is therefore the object of the invention to provide a simple cleaning method for a DMT door, and an apparatus suitable for carrying it out, while being suited at the same time also for other door sealing systems.

SUMMARY OF THE INVENTION

The invention is based on the basic idea that immediately after opening the coke-oven chamber the coke-oven door is still so hot that in the region of the seal edges and the membranes temperatures of approximately 130° C. to 200° C. are present. Therefore, the tar deposited on the inside surface of the membrane and in the region of the seal edges is still so viscous that it can be removed relatively easily with compressed air. The air, which strikes the surface to be cleaned at an acute angle (<45°), acts like a spatula or scraper. Any caking is removed with little effort.

In the simplest case, the nozzle element comprises a single nozzle. The spatula or scraper effect of the nozzle element, and hence the cleaning effect, can be further increased in that the nozzle element comprises a plurality of nozzles that are mounted behind and/or adjacent one another in the direction of movement.

According to one embodiment, the nozzle element comprises a nozzle pair having two nozzles mounted adjacent one another. In this case, one nozzle cleans the gas passages of the DMT door and the other nozzle cleans the inside surface of the membrane.

According to a further embodiment, the nozzle element comprises two nozzles mounted behind one another. The first nozzle is oriented such that the air strikes the surface to be cleaned at an acute angle. The second nozzle is oriented such that the air strikes the surface to be cleaned at an obtuse angle (approximately 90°) like the blow of a hammer. For the cleaning of the door, this produces a combination of scraper and hammer stroke effects. A combination of hammer stroke and scraper effects is likewise possible. In this case the two nozzles must be provided far enough away from one another that the air of the one nozzle strikes at an acute angle in front of the surface being impinged at an obtuse angle by the other nozzle.

According a further embodiment, the nozzle element comprises a double nozzle pair. In this double nozzle pair, the two front nozzles are oriented such that its air strikes the surface to be cleaned at an acute angle, while the two rear nozzles strike the surface to be cleaned at an obtuse angle.

In addition, the cleaning effect of the nozzle element can be increased in that pulsating compressed air is applied to it. A pulsator pump produces a pulsating air stream whose pulsation frequency can be adjusted to requirements. Further improvement of the cleaning action can also be achieved by a rotating air jet, thus increasing the size of the surface to be cleaned. In this way, an advantageous, hammer stroke-like effect is achieved.

A combination of pulsating and rotating air jets is likewise possible.

The cleaning action of the cleaning method according to the invention can also be increased in that the flow cross-sections of the nozzles are reduced and/or the air pressure is increased by a compressor.

In a preferred embodiment, a single nozzle element travels across the entire inside surface of the membrane and the seal edges, the nozzle element initially being moved in the lower door region beginning in the center toward the left and right corners. Then the entire area of the door is covered, and in the lower region the nozzle element is again moved back and forth.

According to a further embodiment, two nozzle elements cover respective halves of the coke-oven door seals.

In a further embodiment, four nozzle elements, that is two for vertical and two for horizontal cleaning of the coke-oven door, are used.

In a further embodiment, the nozzle elements are mounted stationarily. The nozzle elements are preferably configured as double nozzle pairs and spaced at such a distance that the air of the front nozzle strikes the surface to be cleaned at an acute angle at precisely the point at which the air of the nozzle strikes at an obtuse angle from the rear nozzle pair. In this way, cleaning of the entire sealing surface by the stationary nozzles is guaranteed in one operation. Solenoid valves control the compressed air such that the cleaning of the coke-oven door is performed in overlapping sections.

In order to minimize cooling of the surfaces to be cleaned, in a further development of the invention the nozzle element is displaced along the seal edges opposite to the direction of movement of the air that strikes the surface to be cleaned at an acute angle. In this way, cooling of the sealing surface still to be cleaned is largely prevented.

The apparatus according to the invention comprises a housing into which the coke-oven door to be cleaned is moved or placed. In this housing, the one displaceable nozzle element is provided. This housing is preferably provided on the coke pusher or transfer machine. This housing cleans the doors of the respective coke oven to be operated. However, it is also possible to provide a stationary housing in the intermediate and end members of the coke oven batteries, into which the coke-oven door to be cleaned is placed. Due to the enclosure, the pollution developing during cleaning of the coke-oven door cannot exit into the atmosphere. It is instead collected on the walls and ultimately on the floor in a collection pan and added in batches to the feed coal. In order to clean the inside surfaces of the housing, additional nozzle elements can be provided. The collection pan can be covered with a small amount of coal so that the cleaned tar particles do not cake on the pan; the collection pan is drained on the pusher machine in that the tar and coal particles are loaded into the leveling coal bunker located on the pusher machine. On the coke side, the collection pan is drained into a collection receptacle. The content of the collection receptacle is then added to the feed coal. It is also possible to provide a separate collection receptacle on the push side.

According to a further development of the invention, the door-cleaning apparatus comprising the nozzle element can be retrofitted with brushes, scratchers or scrapers on existing mechanical door cleaning apparatuses in that, for example, the brushes are replaced by a nozzle element. Retrofitting has the advantage that existing cleaning apparatuses can be used for the inventive door cleaning method.

The inventive door-cleaning apparatus can also be used to clean all sealing systems known from the state of the art, such as sealing systems with hammer finish strips, Z-strips, and the like. This is also advantageous for retrofitting a coke oven with a DMT door when temporarily different door sealing systems are used simultaneously. When using double nozzle pairs with conventional door sealing systems without gas passages, both the inside membrane surface between the door plug and seal edge and the seal edge itself are cleaned by the compressed-air jet.

To ensure that the hot, viscous tar is not cooled by the air jet, the compressed air is heated according to a further development of the invention.

In order to heat the compressed air, waste heat available in the coking plant is used. Depending on local circumstances, waste heat from the air-cooled pusher rack or from the waste air of air-conditioning systems or from the compression heat can be utilized. The heat can be gained either by direct intake of the hot air or by targeted routing of the compressed air through regions that, due to the coking process, give off increased radiant heat.

The compressed air can also be heated by heating and insulating a compressed-air reservoir. This is possible because the air volume required for cleaning a door is so low that the heating phase between door-cleaning operations is sufficient to heat the air back to at least 80° C., preferably >130° C.

The door-cleaning apparatus according to the invention comprises a compressor that is provided on the respective machine, that is on the push side on the pusher machine and on the coke side on the coke-transfer machine. This compressor is used to bring the air to the necessary pressure. The compressed air is fed to a compressed-air reservoir. From there, it is conducted via fixed and flexible connecting lines to the nozzle element(s). Between the nozzle element and the compressed-air reservoir solenoid valves are provided that are controlled electrically, thus allowing both the air volume and the flow time of the air stream to be defined. In the individual feed lines to the nozzle elements additionally respective pressure regulators are provided that can be used to control the nozzle pressures.

The air volume, the air pressure and in particular the cleaning paths defined by the individual nozzle elements can be controlled electronically by programming. Control can be done via the main PLC (Programmable Logic Controller) of the oven operating machine or by a separate PLC.

The nozzle elements are guided across the surfaces to be cleaned at a spacing of approximately 5 cm. This spacing provides sufficient tolerance to compensate for distortions of the door seals and, unlike mechanical cleaning apparatuses, excellent cleaning is guaranteed in all locations.

BRIEF DESCRIPTION OF THE DRAWING

Further details, features and advantages of the subject matter of the invention will be apparent from the following description of the related figures that illustrate preferred embodiments of the inventive door-cleaning apparatuses by way of example. A detailed description and a figure relating to the cleaning of the housing insides have been foregone. The combination of the necessary elements is obvious and evident. In the figures.

DETAILED DESCRIPTION

Figure 1:
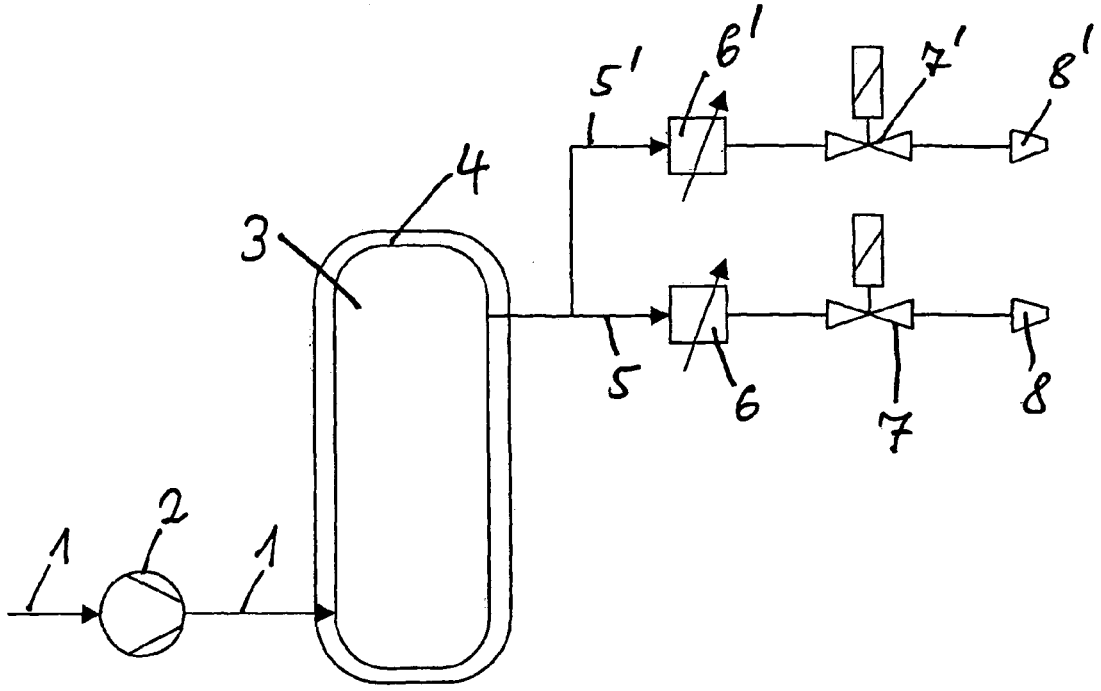
FIG. 1 is a schematic illustration of the compressed-air supply to the nozzle elements.

FIG. 1 shows the compressed-air supply to the nozzle elements. A line 1 feeds air to a compressor 2 that pumps it into a compressed-air reservoir 3. The compressed-air reservoir 3 is provided with a compressed-air reservoir heater 4. From the compressed-air reservoir 3, the compressed air flows via lines 5 and 5', in which pressure regulators 6 and 6' as well as solenoid valves 7 and 7' are provided, into nozzle elements 8 and 8'.

Figure 2:
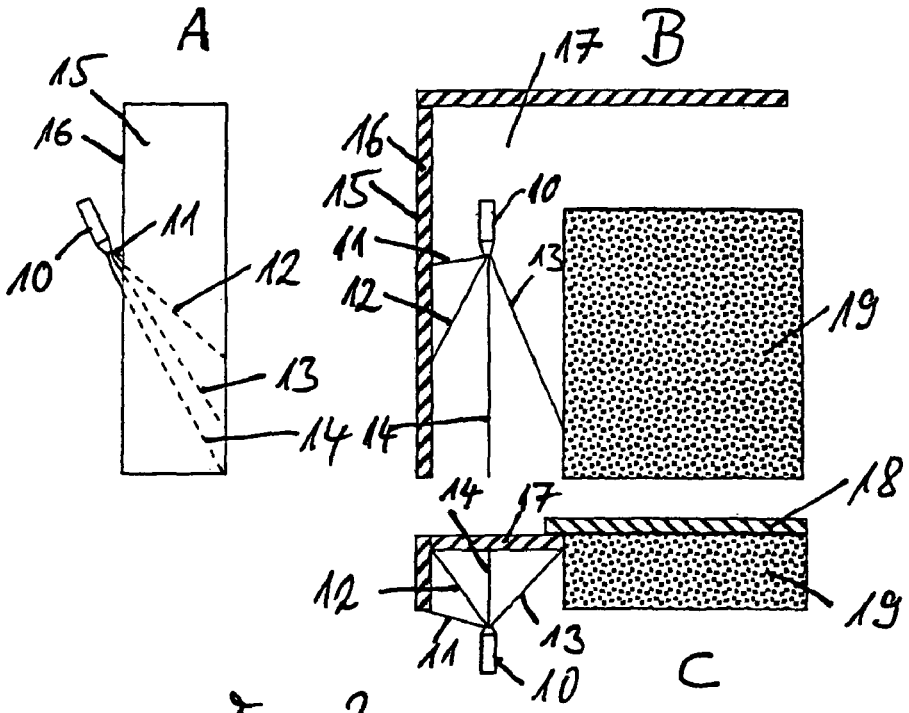
FIG. 2 is a nozzle element comprising one nozzle with an acute angle of incidence.

FIG. 2 shows a side view A, an inside view B and a top view C of the inventive method for cleaning a coke-oven door using a nozzle 10 in a schematic illustration. The nozzle 10 is used to blow compressed air at an acute angle against a seal strip 15 having a seal edge 16 and onto an inside surface of a membrane 17 that is fastened to a coke-oven door plate 18 having a door plug 19. The path of the compressed air is shown by way of example by the jets 11, 12, 13 and 14. The jet 11 strikes the seal edge 16 of the seal strip 15. The jet 12 strikes the region at which the seal strip 15 is fastened to the membrane 17. The jet 13 strikes the region between the membrane 17 and the door plug 18. The jet 18 strikes the center of the inside surface of the membrane 17.

FIG. 2 shows that the nozzle 10 blasts the overall region between the seal strip and the coke-oven door plate with compressed air and that in this way tar deposits are removed by pressurized air and the coke-oven door is cleaned.

Figure 3:
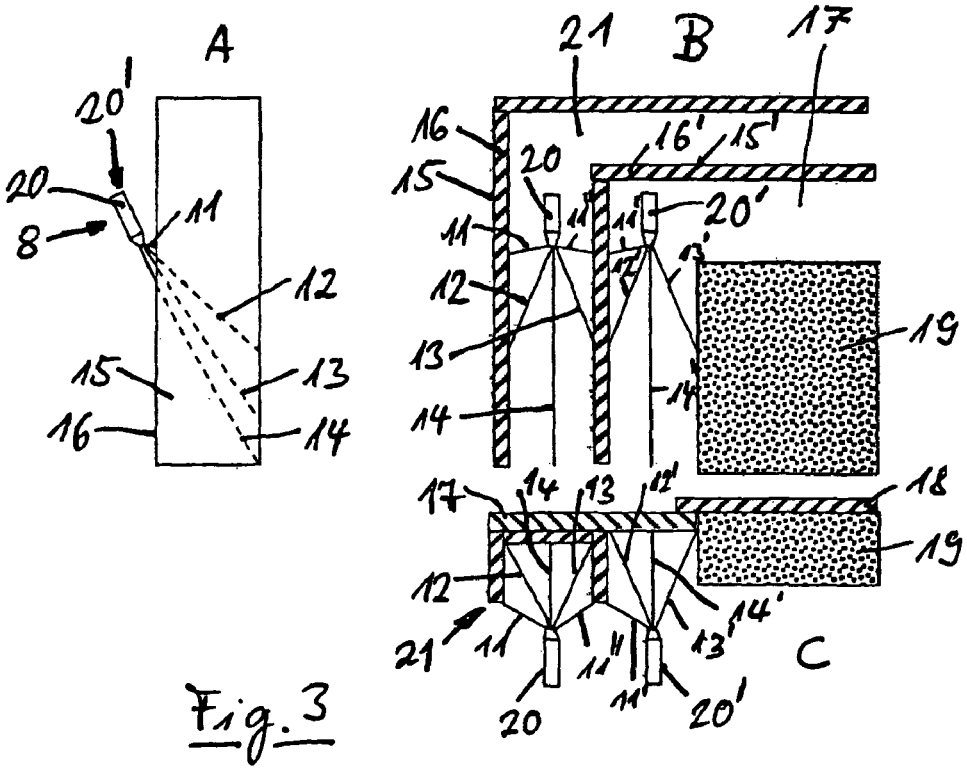
FIG. 3 is a nozzle element comprising two nozzles with an acute angle of incidence.

FIG. 3 shows a nozzle element 8 comprising two nozzles 20 and 20' that are directed at an acute angle of incidence at the dirty seal strip 15 having the seal edge 16 (side view A). The inside view B and top view C show that the coke-oven door is provided with a peripheral gas passage 21 comprising outer seal strips 15 having seal edges 16 and inner seal strips 15' having seal edges 16'. The gas passage 21 is secured to the coke-oven door plate 18 by the membrane 17. As indicated by the jets 11, 12, 13, 14 and 11", the nozzle 20 cleans the gas passage 21. The jets 11', 12', 13' and 14' indicate that the nozzle 20' cleans the inside surface of the membrane 17.

Figure 4:
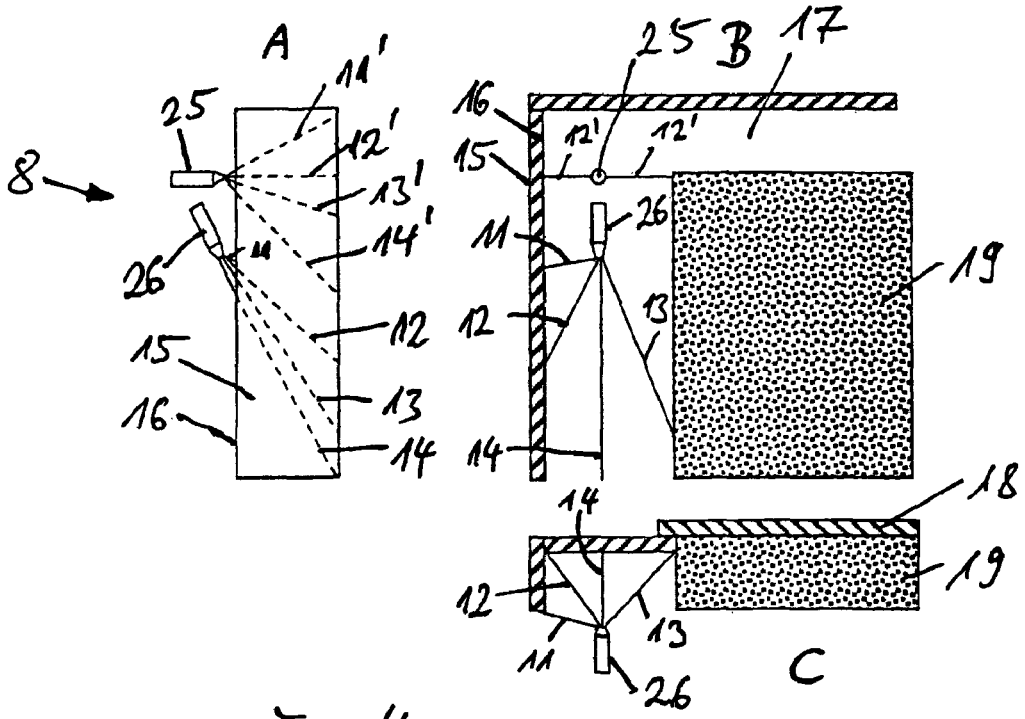
FIG. 4 is a nozzle element comprising two nozzle mounted behind one another, one with an obtuse and one with an acute angle of incidence.

FIG. 4 shows the cleaning of a coke-oven door comprising a seal strip 15 having a seal edge 16 and the membrane 17 using a nozzle 25 having an obtuse of incidence and a nozzle 26 having an acute angle of incidence. The remaining reference numerals have the same meaning as in the previous figures. For clarity reasons, the illustration of the jets 11", 13' and 14' of the nozzle 25 were foregone on the inside view B.

Figure 5:
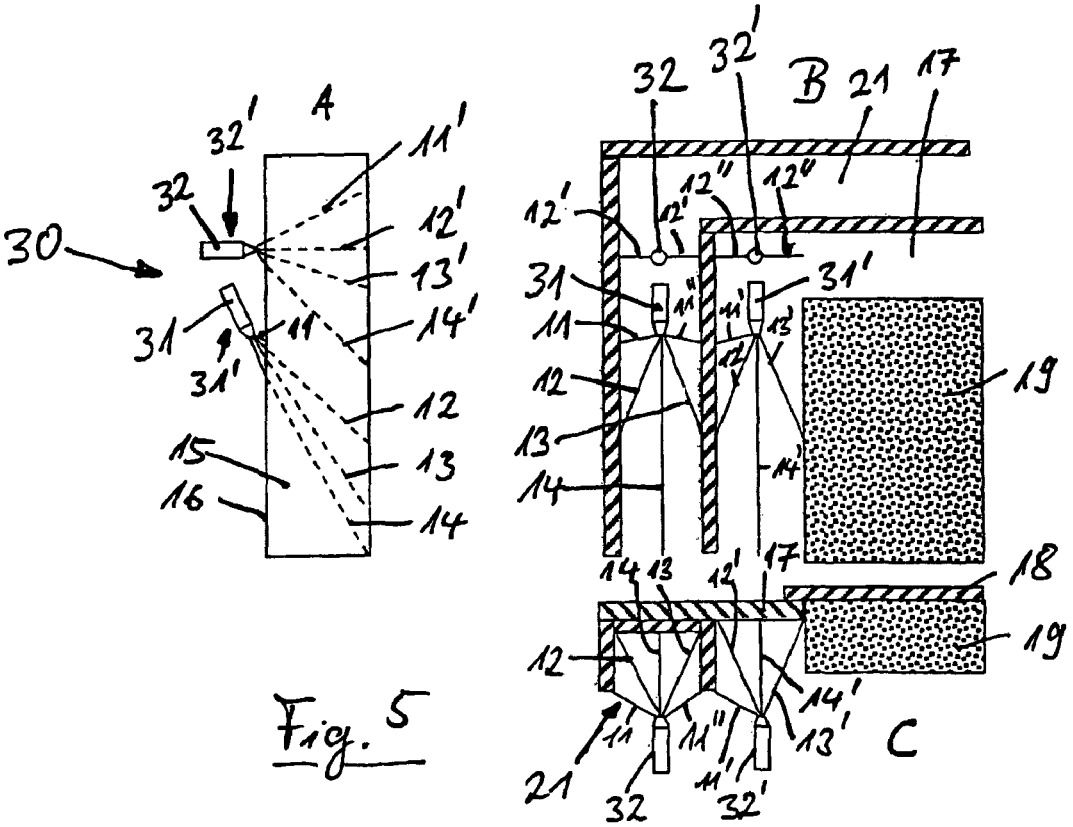
FIG. 5 is a nozzle element configured as a double nozzle-pair assembly comprising two nozzles mounted adjacent one another having an obtuse angle and two nozzles mounted in front thereof having an acute angle of incidence.

FIG. 5 shows the cleaning of a DMT door using a double nozzle-pair assembly 30. The double nozzle-pair assembly comprises two nozzles 31 and 31' that are oriented such that the air strikes the surface to be cleaned at an acute angle, and two nozzles 32 and 32', whose jets strike the surface to be cleaned at an obtuse angle.

The remaining reference numerals have the same meaning as in the previous figures. Again, in the inside view B the illustration of the jets 11', 13' and 14' of the nozzles 32 and 32" was largely eliminated.

Figure 6:
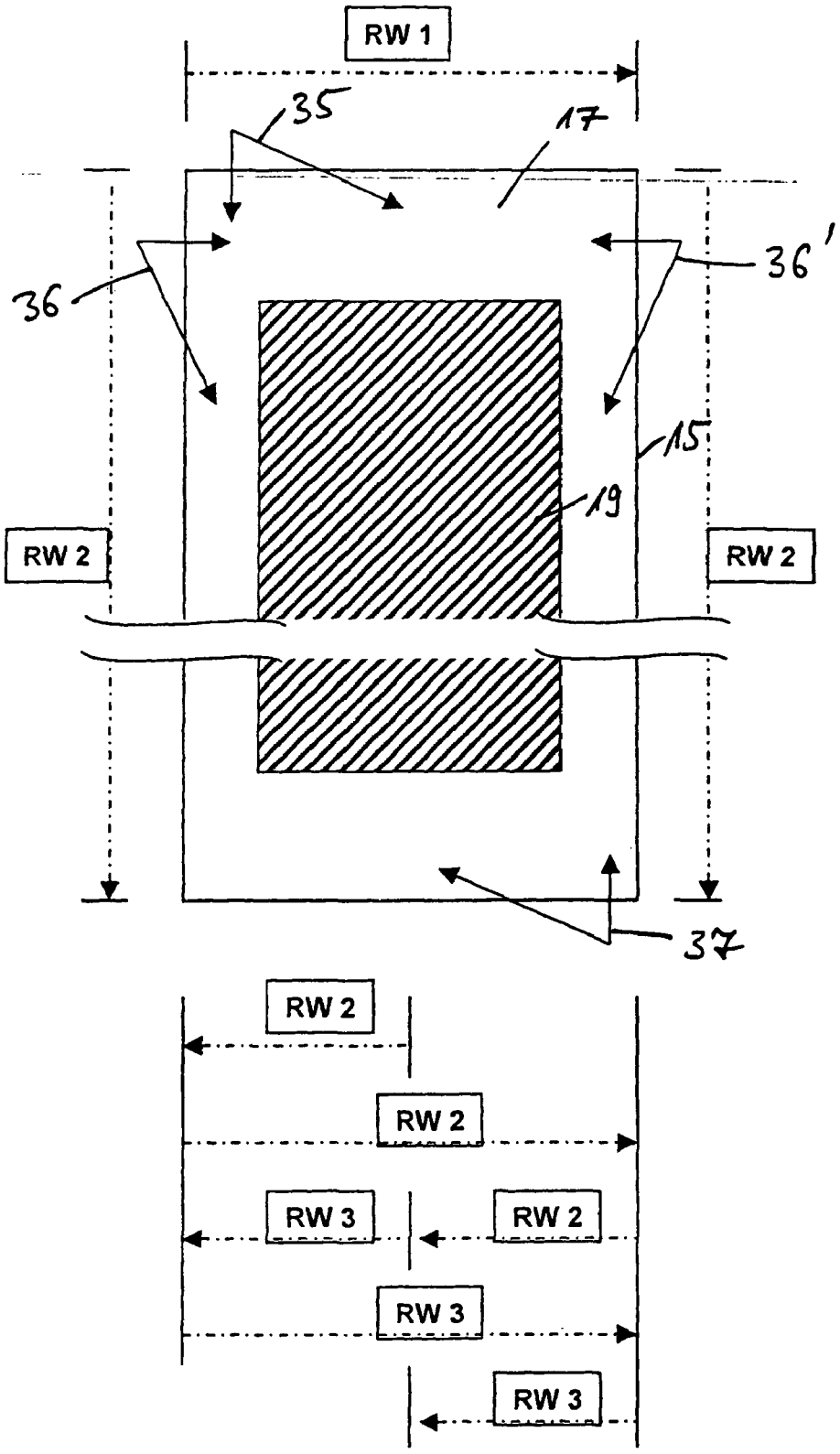
FIG. 6 is a schematic illustration of the progress of the individual cleaning phases of the method for cleaning a coke-oven door, using four double nozzle pairs.

FIG. 6 shows the course of the inventive door cleaning method using four double nozzle pairs. Two double nozzle pairs are used for vertical cleaning and two for horizontal cleaning of the coke-oven door. The chronological sequence of the cleaning operation of the four partial regions is controlled such that dirtying one cleaned sealing surface regions by work on a dirty region is largely avoided. In a first cleaning phase, using the cleaning path RW 1, the upper door region is cleaned by an upper double nozzle pair 35. In a second cleaning phase RW 2, the two side regions are cleaned by double nozzle pairs 36 and 36', starting at the top, and at the same time the lower region of the surface to be cleaned is covered by the double nozzle pair 37. In the lower region, a double nozzle pair 37 is moved, starting from the center, to the left and right corners and back to the center position. In a subsequent third cleaning phase RW 3, the lower region is again cleaned up to the corners by back and forth displacement of the lower double nozzle pair 37. The cleaning phase RW 3 takes into account that the lower region of the coke-oven door is the dirtiest part.

Figure 7:
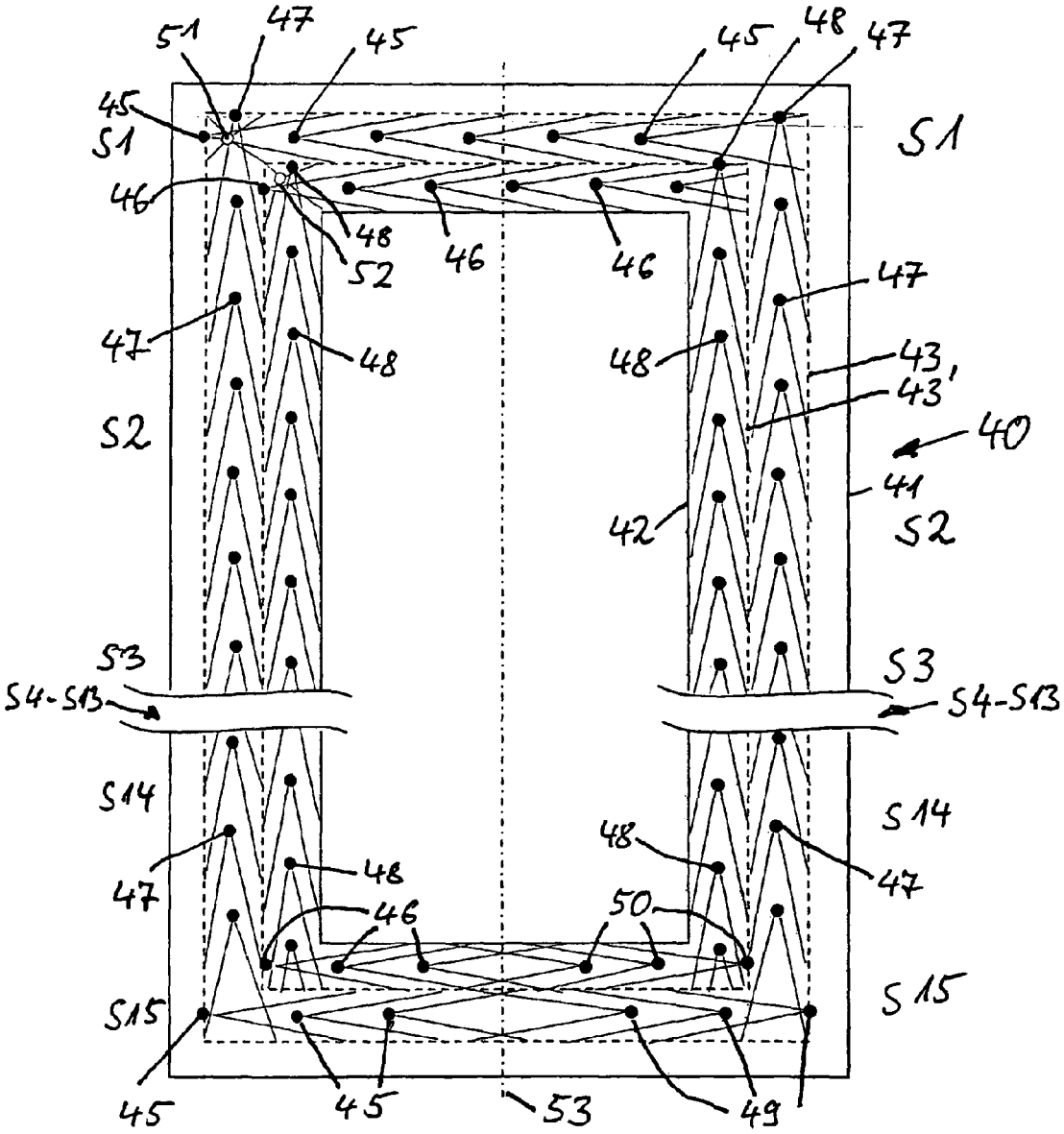
FIG. 7 is an embodiment with stationary arrangement of the nozzle elements.

FIG. 7 shows the inventive coke-oven door cleaning operation using a stationary array of nozzles. The nozzle elements are mounted in a housing 40 comprising an outer housing wall 41 and an inner housing wall 42. The gas passage boundaries 43 and 43' of the DMT door are indicated by the dotted lines. In the housing, nozzles 45, 47 and 49 are provided for cleaning the gas passage and double nozzles 46, 48 and 50 are provided for cleaning the inside surface of the membrane, the nozzles 45 to 50 being directed at the surfaces to be cleaned at an acute angle. The double nozzles are spaced at such a distance that the surfaces that are struck by the air of the nozzles 45 to 50 slightly overlap the surfaces that are struck by the air of the adjacent nozzles 45 to 50. In this way, cleaning of the entire sealing surface by the stationary nozzles 45 to 50 is guaranteed.

As is apparent from FIG. 7, the nozzles 45 and 46 are oriented starting from the left upper corner of the housing 40 to the right. Starting from the right upper corner of the housing 40, the nozzles 47 and 48 blast downward. Starting from the right lower corner of the housing 40, the nozzles 49 and 50 blast to the left. This arrangement is maintained to just before the center 53 of the housing 40.

On the left side of the housing 40, the nozzles 47 and 48 blast downward starting from the left upper corner. The nozzles 45 and 46 blast to the right from the left lower corner of the housing. This jet direction is maintained to just before the center 53 of the housing 40. In the left upper corner of the housing 40 additional nozzles 51 and 52 are provided that strike surfaces that the nozzles 45, 46 and 47, 48 cannot reach.

The coke-oven door is cleaned in sections. One section typically comprises 10 double nozzles, including the nozzles 45 and 46, 47 and 48 or 49 and 50. The nozzles are provided at a spacing of 11 cm. For coke-oven doors measuring approximately 7.40 meters in height, as used, for example, at the Prosper coking plant of Deutsche Steinkohle AG, this means that cleaning is performed successively in fifteen sections S1 to S15. In a first cleaning phase, the upper section S1 is cleaned. Solenoid valves, which are not shown, control the compressed air such that in the upper section S1 six double nozzles, comprising the nozzles 45 and 46 that clean the upper horizontal region of the sealing surfaces, as well as the two upper double nozzles, comprising the nozzles 47 and 48 that are directed downward and the nozzles 51 and 52, are supplied with compressed air. Further cleaning of the door occurs in the sections S2 to S14 that each comprise five double nozzles for each side, starting from the top down to section S15. There, the two lower double nozzles comprising the nozzles 47, 48 blast downward, and the nozzles 45, 46 as well as 49, 50 each blast toward the center 53 of the housing 40. Because due to the selected blasting directions contaminants gather in the lower section S15, the cleaning cycle is extended in this section. The cleaning time in sections S1 to S14 is fifteen seconds each, in section S15 it is thirty seconds. This means a total cleaning time of four minutes. Since the time from lifting off the coke-oven door until reinstalling it is approximately 5 minutes, the cleaning operation does not result in any delays in the operation. With this type of cleaning, complete cleaning of the coke-oven door at relatively low compressor capacity is possible. In addition, pollution of the clean sealing surface regions during the inventive door-cleaning operation by detached contaminants is largely prevented.

The basic idea of the invention, according to which the coke-oven door must be cleaned immediately after opening the coke-oven chamber because due to the temperature of the coke-oven door the tar deposited in the seal edge regions is still viscous enough to be removed relatively easily by compressed air, was demonstrated by the following experiments. First, the temperature profile of the tar in the gas passage of the DMT door during operation of the coking plant was recorded. The temperatures were determined both immediately after opening the door and after a cooling phase of approximately 5 minutes. In order to simulate the cooling of the coke-oven door by the inventive cleaning method using compressed air, during the cooling phase the appropriate regions of the coke-oven door were subjected to compressed air. The temperatures in the gas passage before the cooling phase ranged between 180° and 200° C. and after the cooling phase between 140° C. and 160° C. The tar was liquid in each case. During the brief cooling phase, however, it became more viscous as the temperature decreased.

After the temperature profile was recorded, experiments like those described below were performed at the test facility:

A piece of the gas passage measuring approximately 50 cm in length, including the membrane, was severed out of an original door seal and mounted horizontally onto a heating plate using screw clamps. Then, the gas passage and the membrane surface were coated with a uniform amount of tar from the door region of a coking plant. This tar was heated to approximately 135° C. by means of the heating plate. In order to remove the tar, both a compact nozzle and a fan nozzle were displaced at a predefined spacing of 3-5 cm and an angle of approximately 40° across the region of the gas passage and the membrane. The air pressure was always 10 bar.

The cleaning action was determined by reweighing the removed section (gas passage and membrane piece). The results are listed in Table 1.

TABLE 1

Cleaning experiments using air nozzles and hot tar

| Exp. No. | Nozzle Type | Spacing Nozzle to Gas Channel (mm) | Angle of Incidence (° C.) | Tar Temperature (° C.) | Tar Volume before Cleaning (g) | Tar Volume after Cleaning (g) | Cleaning Efficiency (g) | Cleaning Efficiency (%) |
|---|---|---|---|---|---|---|---|---|
| 1 | Compact | 50 | 40 | 133 | 30 | 3 | 27 | 90 |
| 2 | Compact | 50 | 40 | 131 | 30 | 3 | 27 | 90 |
| 3 | Fan | 50 | 40 | 134 | 30 | 3.5 | 26.5 | 88 |
| 4 | Compact | 30 | 40 | 133 | 30 | 2 | 28 | 93 |
| 5 | Compact | 30 | 40 | 135 | 30 | 1.5 | 28.5 | 95 |
| 6 | Fan | 30 | 40 | 135 | 30 | 4 | 26 | 87 |
| 7 | Compact | 30 | 40 | 135 | 30 | 3 | 27 | 90 |
| 8 | Compact | 30 | 40 | 134 | 30 | 2 | 28 | 93 |
| 9 | Compact | 30 | 40 | 134 | 30 | 1.5 | 28.5 | 95 |
| 10 | Fan | 30 | 40 | 133 | 30 | 4 | 26 | 87 |

As Table 1 shows, in general cleaning efficiencies of approximately 90 to 95% were achieved.

In a further series of experiments, the cleaning efficiency was determined for cooler tar. For this purpose, the tar was first heated to 135° C. and cooled back down to approximately 100° C. before the cleaning operation by compressed air was conducted. The results are listed in Table 2.

TABLE 2

Cleaning experiments using air nozzles and cooler tar

| Exp. No. | Nozzle Type | Spacing Nozzle to Gas Channel (mm) | Angle of Incidence (° C.) | Tar Temperature (° C.) | Tar Volume before cleaning (g) | Tar Volume after cleaning (g) | Cleaning Efficiency (g) | Cleaning Efficiency (%) |
|---|---|---|---|---|---|---|---|---|
| 1 | Compact | 30 | 40 | 135/105 | 30 | 22 | 8 | 27 |
| 2 | Compact | 30 | 40 | 135/105 | 30 | 24 | 6 | 20 |
| 3 | Compact | 30 | 40 | 134/100 | 30 | 25.5 | 4.5 | 15 |
| 4 | Compact | 30 | 40 | 135/100 | 30 | 25 | 5 | 17 |
| 5 | Compact | 15 | 40 | 133/90 | 30 | 28 | 2 | 7 |
| 6 | Compact | 15 | 40 | 134/90 | 30 | 29 | 1 | 3 |
| 7 | Compact | 15 | 40 | 135/100 | 30 | 28 | 2 | 7 |
| 8 | Compact | 15 | 40 | 134/100 | 30 | 26 | 4 | 13 |
| 9 | Fan | 30 | 40 | 135/100 | 30 | 25 | 5 | 17 |
| 10 | Fan | 15 | 40 | 135/100 | 30 | 23 | 7 | 23 |

As is apparent from Table 2, the cleaning efficiencies achieved with the cooler and harder tar were considerably worse. They were in the range of <30% efficiency.

These experiments support the conclusion that the hot, liquid tar that adheres to the door seals immediately after opening the door of the coking plant operation can be removed without difficulty using compressed air that strikes the surfaces to be cleaned at an acute angle. Small amounts of tar that are not removed from the gas passage do not impair the sealing efficiency of the DMT door. It is to be expected that complex basic cleaning, for example by means of sand blasting, should not be required until quite some time later, approximately after 18 months, for example. With the inventive method for cleaning a coke-oven door, the disadvantages of door-cleaning methods according to the prior art, such as damage to and wear on the sealing surfaces by scrapers or the processing and handling of waste water required when cleaning with water nozzles, do not occur.

Illustrated Embodiment

The door-cleaning apparatus according to the invention comprises four double nozzle elements that are configured as double nozzle pairs, one nozzle of each pair being oriented at an obtuse angle and the other nozzle being oriented at an acute angle at the surfaces to be cleaned. Two double nozzle pairs are used for the horizontal door regions and two double nozzle pairs for the vertical door regions. The door is placed in an enclosed cleaning apparatus immediately after opening the coke-oven chamber, so that on the one hand fast cooling of the surfaces to be cleaned and on the other hand pollution of the push side by tar and coke particles detached by cleaning are prevented. The enclosure is connected in the upper region to an extraction hood that is connected to the existing exhaust system, so that the polluted compressed air does not escape into the atmosphere. In the lower region a collection pan is provided in which the detached tar particles are collected. The chronological sequence of the cleaning operation of the four partial regions is controlled such that the pollution of clean sealing surface regions by other not completely clean regions or by detached contaminants is largely prevented.

In a first cleaning phase, the upper door region is cleaned by the upper double nozzle pair. In a second cleaning phase, the two side regions are cleaned starting from the top, and at the same time the lower region of the surface to be cleaned is cleaned. In the lower region, the double nozzle pair is displaced starting from the center to the left and right corners and returned to the center position. In a subsequent third cleaning phase, the lower region is cleaned again by displacing the lower double nozzle pair back and forth from the left to the right corner, starting from the center.

In order to achieve ideal cleaning of the regions of the door seals contaminated with tar and coke, the air is compressed to a sufficiently high pressure level by means of a compressor and then pulsed and rotated by inserts in the nozzles. These measures guarantee that the compressed-air jets are able to clean all regions of the gas passage and of the inner membrane surface.

Since it was found based on the above experiments that optimal cleaning is achieved at temperatures above 130° C., the compressed air in the pressurized reservoir is preheated to approximately 130° C. by jacket heating and insulation. The heating process is designed such that the air volume present in the pressurized reservoir is reheated during the time between the individual coke-pushing operations.

Heating of the inside walls of the enclosure keeps the precipitated tar in the liquid state, thus allowing it to flow out and be collected in the collection pan provided on the bottom.

By the inventive cleaning apparatus the door was reliably cleaned so well that during the coking operation complete sealing of the coke-oven chamber by the DMT door was guaranteed at all times. No emissions resulting from leaking coke-oven doors were observed.

The invention claimed is:

1. A method for cleaning a coke-oven door having seal edges and membranes attached to a coke-oven door plate, the method comprising the step of:

pressurizing a cleaning tool having a nozzle that projects a compressed-air jet;

opening the coke-oven door while the seal edges and membranes are at a temperature of 130° C. to 200° C.; and immediately thereafter cleaning the coke-oven door by displacing the nozzle back and forth between and along the seal edges and the coke-oven door plate while directing the jet of the compressed air at the membranes and seal edges such that tar is removed from inside surfaces of the membranes and the seal edges; and orienting the nozzle such that the compressed-air jet strikes the surface to be cleaned at an acute angle of less than 45°.

2. The method according to claim 1 wherein the nozzle is displaced across the entire inside surfaces to be cleaned.

3. The method according to claim 1 wherein the cleaning tool further comprises two nozzles that are each displaced across a respective half of the inside surfaces to be cleaned.

4. The method according to claim 1 wherein the cleaning tool further comprises four nozzles that are displaced across the inside surfaces to be cleaned, two of the four nozzles being used to clean vertical surface sections and the other two of the four nozzles being used to clean horizontal surface sections of the coke-oven door.

5. The method according to claim 1, further comprising the step immediately after opening the coke-oven door of:

moving the coke-oven door into a closed housing in which the nozzle is provided.

6. The method according to claim 1 wherein the air is compressed by a compressor.

7. The method according to claim 1, further comprising the step of heating the compressed air.

8. The method according to claim 1, further comprising the step of:

electronically controlling an air volume of the compressed air by solenoid valves, an air pressure of the compressed air by pressure regulators, and the displacement of the nozzle by a drive mechanism.

9. The method according to claim 1, further comprising the step of heating the nozzle.

10. The method according to claim 1, further comprising the step of:

pulsing the jet of compressed air.

11. The method according to claim 1, further comprising the step of rotating the compressed-air jet with the nozzle.

12. The method according to claim 1, further comprising the step of pulsing and rotating the compressed air.

13. The method according to claim 5, further comprising the steps of:

extracting the compressed air from the housing by an extraction apparatus and removing and collecting the tar in a collection pan.

14. The method according to claim 5, further comprising the step of heating the housing.

* * * * *